US005443167A

United States Patent [19]

Menaged et al.

[11] Patent Number: 5,443,167

[45] Date of Patent: Aug. 22, 1995

[54] MERCHANDISING DISPLAY SYSTEM

[76] Inventors: Neal M. Menaged, 1714 Fredendall Cir., South Hampton, Pa. 18966; Lewis M. Hendler, 1420 Greenwalt Rd., Huntingdon Valley, Pa. 19006

[21] Appl. No.: 250,051

[22] Filed: May 27, 1994

[51] Int. Cl.[6] ..... A47F 5/00

[52] U.S. Cl. ..... 211/87; 211/59.1; 211/103; 211/189

[58] Field of Search ..... 211/189, 59.1, 57.1, 211/190, 193, 87, 103, 208; 108/108, 109

[56] References Cited

U.S. PATENT DOCUMENTS

| | | | |
|---|---|---|---|
| 2,802,576 | 8/1957 | Kelling . | |
| 3,329,282 | 7/1967 | Swan et al. | 211/190 |
| 3,856,146 | 12/1974 | Levine . | |
| 3,892,189 | 7/1975 | Killam | 108/109 |
| 3,971,477 | 7/1976 | Bruderly et al. . | |
| 4,093,078 | 6/1978 | Radek . | |
| 4,561,550 | 12/1985 | Franklin . | |
| 4,632,473 | 12/1986 | Smith | 211/189 X |
| 4,697,712 | 10/1987 | Valiulis . | |
| 4,785,946 | 11/1988 | Sorensen . | |
| 5,016,764 | 5/1991 | Bauer . | |
| 5,205,421 | 4/1993 | Bustos . | |
| 5,303,830 | 4/1994 | Metcalf . | |

OTHER PUBLICATIONS

Undated assembly instructions entitled "Philips Eckerds Gondola Space Saver".

*Primary Examiner*—Robert W. Gibson, Jr.
*Attorney, Agent, or Firm*—Harness, Dickey & Pierce

[57] ABSTRACT

An auxiliary display assembly for a gondola merchandising display unit is provided. The auxiliary display assembly is adapted to releasably attach to an upright support member of the gondola display unit and includes first and second cantilever members which are interconnected by an otherwise free standing vertical member. The vertical member is formed to include a plurality of apertures which are adapted to receive a peg member. The auxiliary display assembly is constructed such that the peg member is ultimately positioned substantially parallel to and spaced apart from a wall portion of the gondola display unit.

11 Claims, 2 Drawing Sheets

MERCHANDISING DISPLAY SYSTEM

BACKGROUND AND SUMMARY OF THE INVENTION

The present invention relates, in general, to merchandising display systems. More particularly, the present invention relates to an auxiliary display assembly for a gondola merchandising display unit.

The self-service retail industry demands efficient display of product while minimizing floor space requirements. The merchandise display capacity of a self-service retail store is inherently limited by the store's square footage of interior space. In this regard, the amount of area available within a store directly limits the amount of product which may be effectively displayed for sale. Heretofore, various merchandising display devices have been employed to increase the merchandising display capacity of a store.

One such device commonly used to increase a store's merchandising capacity is a gondola display unit. In its basic sense, a gondola display unit includes a base, a wall portion upwardly extending from the base from which products can be displayed for sale, and a plurality of spaced apart upright supports attached to the wall portion. The wall portion is constructed from pegboard and includes a multiplicity of apertures equally spaced in rows and columns about its entire surface. Typically, the gondola display units are arranged end to end to define aisleways throughout the interior of a store.

Gondola display units are generally constructed so that they may be utilized in one of two forms—shelf-type units and peg-type units. An illustrative gondola display unit of the shelf-type is described in U.S. Pat. No. 5,205,421. In the shelf-type units, shelves or racks are supported by shelving brackets attached to two adjacent upright supports. Shelf-type units are widely incorporated in self-service retail stores to aesthetically display the product for sale in a manner appealing to the average consumer. The shelf-type units are typically designed to permit an unobstructed view of products, to permit easy removal and replacement of the product on the display, and to provide the capability of storing a limited inventory of products to limit the frequency of restocking the display. Such prior gondola display units have been designed to accommodate various types of products. The gondola shelves afford consumers a clear view of the goods and are approachable from three sides. Further, the shelves of such gondola systems are sufficiently wide to carry a limited inventory of goods.

When the gondola display unit is utilized as a peg-type unit, the product is displayed from pegs adapted to removably engage one or more apertures in the pegboard surface. The pegs are designed to retain a limited supply of product, thereby limiting the frequency of restocking. Such a peg-type unit provides a significant degree of flexibility to readily accept various sized product. Further, such a peg-type system can be readily assembled, unassembled or redesigned. When the gondola display unit is utilized as a peg-type unit, the upright supports do not serve any function.

While prior gondola merchandising display systems have generally proven satisfactory for the display of product in self-service retail stores, none are without their drawbacks and/or limitations. In an attempt to overcome the shortcomings of existing gondola display systems and to further increase display capacity, various alternate display systems have been utilized.

One such alternative device used to increase the display capacity of self-service retail store is shown in U.S. Des. Pat. No. 257,709. The device described therein includes an elongated strip which includes a plurality of retainers vertically spaced about its length. Art aperture at the end of the elongated strip permits the device to be hanged from a peg or the like. Each of the retainers is designed to hold and retain a single product. The device is intended to be disposed once it is emptied of product.

Another such alternative device for increasing the merchandising display capacity of a self-service retail store is a self-standing "point of sale" display. This type of device is often temporarily utilized to marquee new products and is generally provided by the product manufacturer. Self-standing displays limit available floor space and often impede traffic flow.

One limitation common with most prior known merchandising display systems is the limit of the number of facings of merchandise which can be displayed substantially without obstruction. The usable merchandising space for peg-type gondola displays generally is limited by the amount of area on the wall-type surface of the unit. Similarly, the useable merchandising space for a shelf-type unit is generally limited by the combined linear length of the shelving.

Another problem with many prior merchandising display units is that the display units require a significant amount of floor space. Still yet other prior merchandising display devices need to be hung from hooks or pegs which are often not readily available.

Accordingly, it has been one object of the present invention to provide a lateral display assembly which creates additional display space for existing gondola merchandising structures while retaining sufficient consumer visibility of product on the original structure and without impeding traffic flow.

It has been yet another object of the present invention to provide a merchandising display system which increases product sales by increasing product visible to the customer and focuses the view of the customers.

It has been still yet another object of the present invention to efficiently utilize the otherwise dead space occupied by the upright supports of a gondola display assembly when the gondola display assembly is functioning as a peg-type unit.

In a first form thereof, the present invention is directed to an auxiliary display assembly for a gondola merchandising unit. The gondola merchandising unit is of conventional structure having a base, an upwardly extending wall portion and at least one upright support extending vertically from the base and having a column of vertically spaced slots therein. The auxiliary display assembly includes at least first and second cantilever members, each having a distal end and a proximal end. The auxiliary display assembly further includes a dependent vertical member interconnecting the distal ends of the first and second cantilever members and at least one peg member adapted to receive and retain a plurality of products. In the preferred embodiment, the auxiliary display assembly includes three cantilever members. Further, in the preferred embodiment, hooks are located at the proximal ends of both of the cantilever members for removable attachment to the upright support member.

One advantage of the present invention is that an auxiliary display assembly has been provided which allows the capacity of an existing gondola display unit to be quickly and easily increased without obscuring the view of the original product display area.

Yet another object of the present invention is that a gondola merchandising display assembly has been provided which more effectively displays a large number of products such that the products are visible from the end of an aisle, thereby serving to draw customers down the individual merchandise aisleway.

These and other objects and advantages of the present invention will become more readily apparent during the following detailed description taken in conjunction with the drawings herein, in which:

DESCRIPTION OF THE PREFERRED EMBODIMENT

Figure 1:
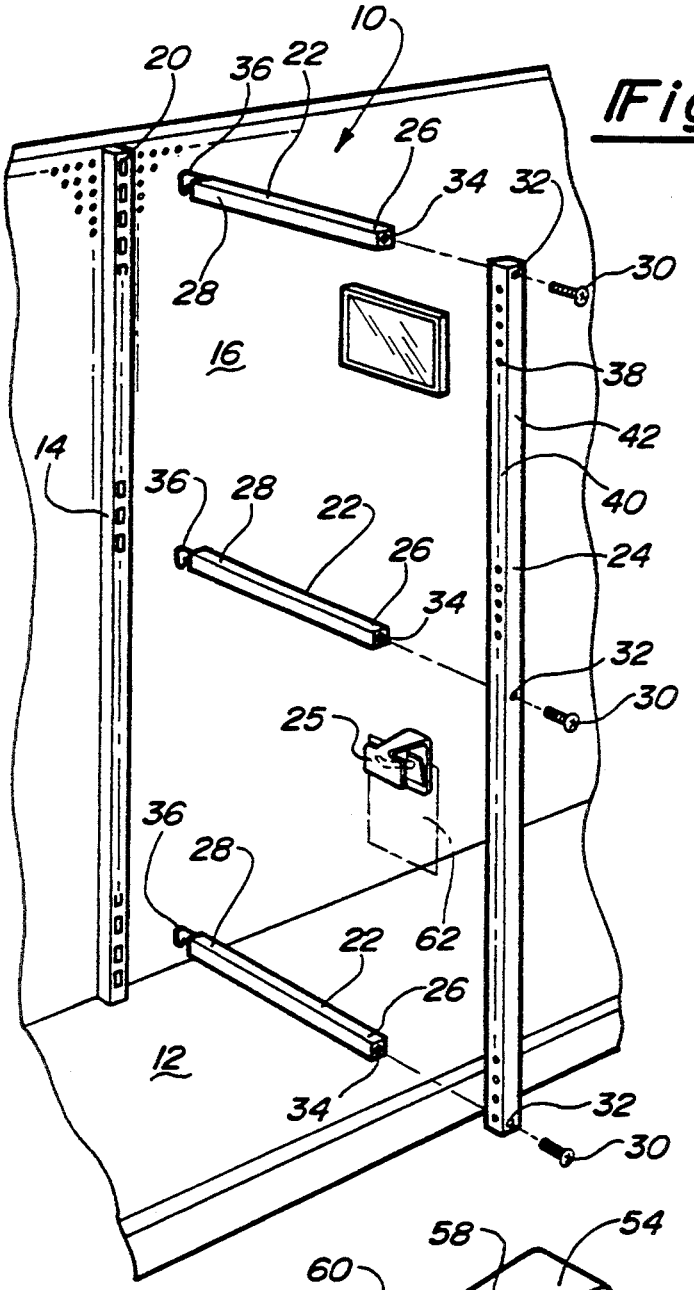
FIG. 1 is a partially exploded perspective view of an auxiliary display assembly constructed in accordance with the teachings of the preferred embodiment of the present invention shown in operative cooperation with a conventional gondola display unit.

Referring generally to the Figures, an auxiliary display assembly for a gondola merchandising display unit constructed in accordance with a preferred embodiment of the present invention is shown and designated with the reference numeral 10. The auxiliary display assembly 10 is shown in operative cooperation with a conventional gondola merchandising display unit. Prior to addressing the details of the auxiliary display assembly 10, it is necessary to briefly detail the gondola display unit into which the auxiliary display assembly 10 is intended to be incorporated.

Figure 2:
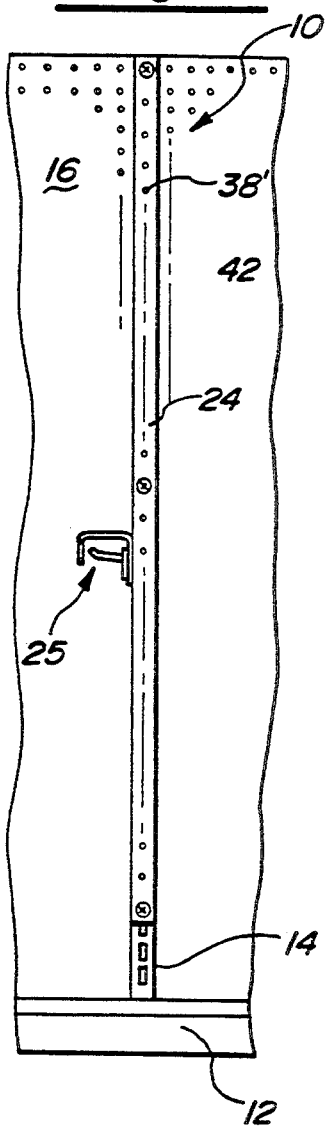
FIG. 2 is a partial side view of the auxiliary display assembly of FIG. 1.

With reference to FIGS. 1 and 2, the gondola display unit is of conventional construction and is shown to generally include a base member 12, at least one upright support member 14, and a wall-type display area 16. The base member 12 is preferably adapted to rest on the store floor (not shown) and provide stability for the remainder of the display unit. The base member 12 shown in FIGS. 1 and 2 is of conventional construction. It will be appreciated by those skilled in the art that similar types of units incorporating a second side which is a substantial mirror image to that shown in FIG. 1 are incorporated to create aisleways within the store interior.

The wall-type display area 16 constructed of a material commonly referred to as pegboard. The pegboard generally includes a multiplicity of equally sized holes evenly distributed in rows and columns across the entire area of the pegboard. As will be appreciated by those skilled in the art, the pegboard is readily adapted to receive specially designed pegs which are adapted to receive and retain product for display. A typical peg 18 is shown in phantom in FIG. 4 and includes a plurality of product carried thereon. Thus, the pegboard provides a display area 16 from which product can be displayed for sale. The display area 16 is substantially parallel to the aisleway (not shown) defined by two spaced apart gondola display units. As a result, the display area 16 is generally perpendicular to the line of purchaser traffic down the adjacent aisleway.

Typically, the pegs 18 adapted to attach to the wall-type display area 16 are sized relative to the width of the base member 12 such that there is frequently a space gap between the distal end of the pegs 18 and the outermost point of the base member 12.

The upright support member 14 extends vertically from substantially adjacent the base member 12 and includes a plurality of vertically spaced slots 22 arranged in a first column thereon. As will be appreciated by those skilled in the art, such upright support members 14 are typically provided in pairs in equally spaced increments along the length of a gondola display units and are adapted to receive shelf brackets (not shown) and the like. The upright support members 14 are typically spaced apart at intervals of approximately four feet in length.

Figure 4:
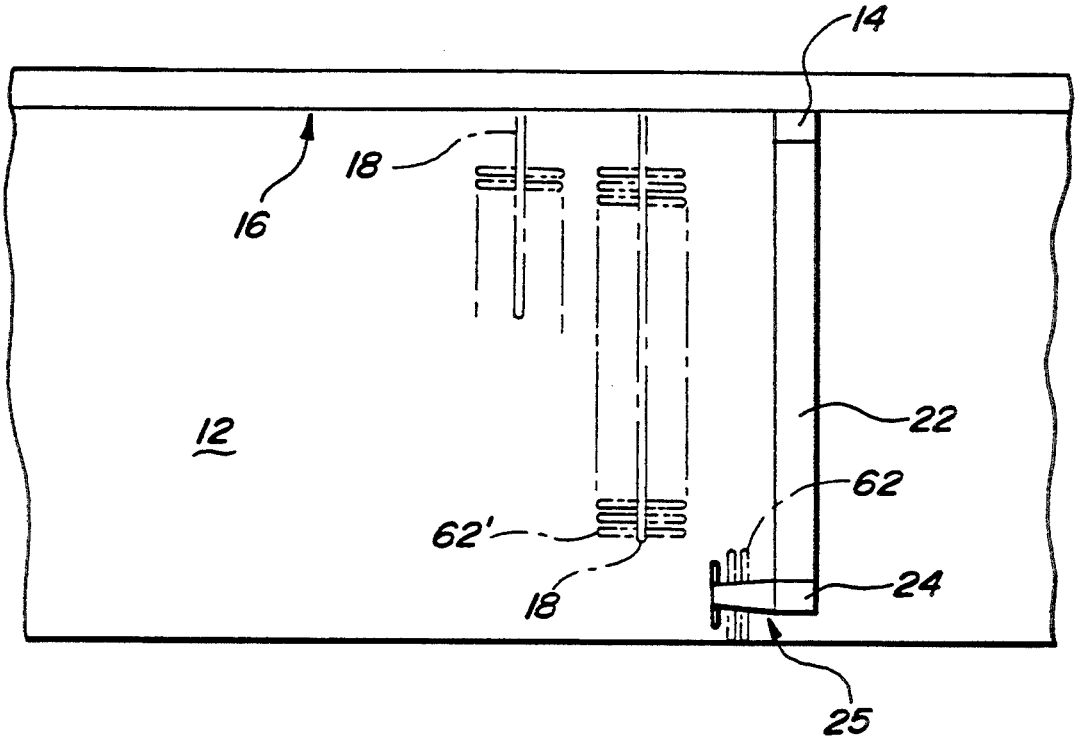
FIG. 4 is a top view of the auxiliary display assembly FIG. 1 showing a conventional peg extending from the pegboard and carrying a plurality of product (shown in phantom), and further depicting product (shown in phantom) carried by a peg member attached to the auxiliary display assembly.

Referring to FIGS. 1, 2 and 4, the auxiliary display assembly 10 of the present invention will now be described in greater detail. Preferably, the auxiliary display assembly 10 includes at least two cantilever members 22, a vertical member 24 and at least one peg member 25. In the exemplary embodiment illustrated, the auxiliary display assembly 10 includes three cantilever members 22. The cantilever members 22 each include a distal end 26 attached to the vertical member 24 and a proximal end 28 adapted to removably engage the upright support member 14. It will be appreciated by those skilled in the art, that the exact number of cantilever members 22 incorporated into the auxiliary display assembly 10 is dependent upon such factors as the length of the cantilever members 22, the length of the vertical member 24, and the amount and weight of product to be suspended from the auxiliary display assembly 10.

Each of the cantilever members 22 is preferably constructed of an elongated metal rod. In the exemplary embodiment, the cantilever 22 each include a rectangular cross section. The length of the cantilever members 22 is directly dependent upon the width of the base member 12. As will be appreciated more fully below, appropriate relative dimensions between the existing pegs 18 of the gondola display unit, the width of the base member 12 and the cantilever members 22 permit products to be suspended a sufficient distance from the display area 16. As a result, additional display area is created from the otherwise dead space occupied by the upright support member 14 while retaining sufficient visibility of product carried by the pegs 18 attached to the existing pegboard. It will be appreciated by those skilled in the art that the cross section and length of the cantilever members 22 are strictly a matter of design choice and can alternatively be circular or of any other cross sectional dimension without departing from the scope of the present invention.

The distal end 26 of each of the cantilever members 22 is preferably adapted to receive a threaded fastener such as a screw or a bolt. In the preferred embodiment, a screw 30 passes through an aperture 32 located at the top, middle, and bottom of the vertical member 24 and engages a threaded aperture 34 formed in the distal end 26 of the cantilever members 22. It will be appreciated by those skilled in the art that the cantilever members 22 can be alternatively integrally formed with the vertical member 24 or welded or otherwise permanently fastened to the vertical member 24.

Preferably, the proximal end 28 of each of the cantilever members 22 includes a hook 36 adapted to releasably engage one of the vertically spaced slots 20 formed in the upright support member 14. As a result, the auxiliary display assembly 10 can be installed and removed quickly and easily as a unit to existing gondola display units.

The vertical member 24 of the auxiliary display assembly 10 is preferably rectangular in cross section. Further preferably, the vertical member 28 is formed to include a column of vertically spaced apertures 38 along each of the pair of opposing sides 40 which are adapted to be disposed substantially perpendicular to the wall-type display area 16. The apertures 38 are adapted to receive one or more of the peg members 25. In the exemplary embodiment illustrated, the vertical member 24 does not extend to the base member 12. The clearance afforded between the base member 12 and bottom end of the vertical member 24 is designed to accommodate the display of product on the top of the base member 12. Thus, the distance that the vertical member 24 extends vertically downward is strictly a matter of design choice and can be readily modified to meet the specific needs of an application. For example, if the retail establishment desires to provide "dump buckets" along the top of the base member 12, a greater distance can be provided between the bottom end of the vertical member 24 and the base member 12. Alternatively, if no storage capacity is desired along the top of the base member 12, the vertical member 24 can extend vertically down to the base member 12.

Alternatively, while not preferred, the vertical member 24 of the auxiliary display assembly 10 can be formed to additionally include a column of vertically spaced apertures 38' (shown in phantom) along its outer side 42, which is substantially parallel to the wall-type display area 16. Such a construction is not preferred since any mounting structure retained by the apertures 38' in the outer side 42 of the vertical member 24 would extend into the adjacent aisleway. However, certain display applications may require this type of arrangement.

The resulting construction of the auxiliary display unit 10 of the present invention is relatively open. Thereby, a substantially unimpeded view of product carried adjacent to the wall portion 16 is retained.

Figure 3:
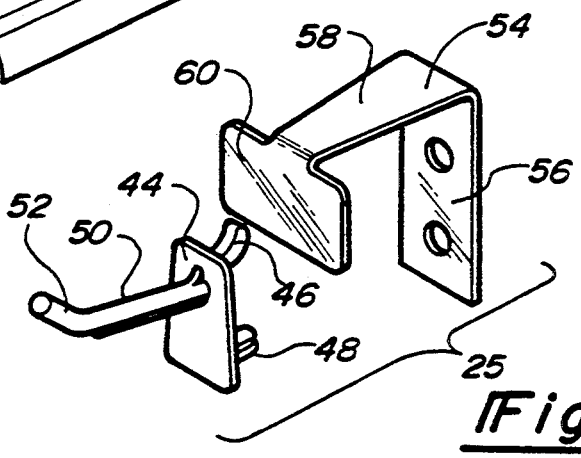
FIG. 3 is an enlarged exploded view of the peg member illustrated in FIGS. 1 and 2.

Turning to FIG. 3, the peg member 25 of the present invention will be described in further detail. The peg member 25 of the present invention preferably includes a main body portion 44, first and second rearwardly extending arm portions 46, 48, and a forwardly extending arm portion 50. The first and second rearwardly extending arms 46, 48 are adapted to engage two of the apertures 38 formed in the vertical member 24. In this regard, the first rearwardly extending arm 46 curves slightly upward relative to the main body portion 44. In use, the first rearwardly extending arm 46 is inserted into one of the apertures 38 of the vertical member 24 and serves to removably retain the peg member 25. As will be appreciated by those skilled in the art, the second rearwardly extending arm 48 cooperates with the first rearwardly extending arm 46 to limit unintended movement or removal of the peg member 25.

The forwardly extending arm 50 of the peg member 25 curves upwardly at its distal end 52 and is attached to the main body portion 44. In the exemplary embodiment illustrated, the forwardly extending arms 50 of the peg member 25 is approximately two inches in length. The length of the forwarding extending arm 50 permits a sufficient capacity to stock products thereon, but does not unnecessarily extend so as to obstruct a consumer's view of and access to product carried by the pegs 18 hung from the pegboard.

The peg member 25 of the present invention is shown to include a two piece construction that includes a shield portion 54. The shield portion 54 is generally of a L-shaped construction including first and second legs 56, 58. The shield portion 54 is integrally formed to include a planar message portion 60 at the free end of the second leg 58. The planar message portion 60 can be affixed with scanner information or advertising information specific to the product displayed. The shield portion 54 preferably extends beyond the forwardly extending arm 56 of the peg member 25, thereby further tending to retain product carried thereon. The shield portion 50 also functions to protect customer traffic along the adjacent aisleway from inadvertent contact with the forwardly extending arm 50. The shield portion 50 of the peg member 25 is preferably unitarily constructed from a clear plastic material. Further preferable, the material of the shield portion 54 is sufficiently flexible and memory retaining to allow the second leg 54 of the shield portion 54 to be slightly lifted to allow easy loading of the forwardly extending arm 50.

The peg member 25 of the present invention 10 is preferably located such that the forwardly extending arm 50 which is adapted to carry the product extends substantially perpendicular to the adjacent aisleway (not shown) created by the gondola display unit. As specifically shown in FIG. 4, the auxiliary display assembly 10 of the present invention is designed to utilize the otherwise dead space that exists along conventional gondola display units at the upright support member 14 and the space gap between the distal ends of the pegs 18 and the outermost point of the base member 12. In this regard, the auxiliary display assembly 10 laterally extends from the wall-type portion 16 and is adapted to provide a merchandising display area between the outermost edge of the base member 12 and the ends of the existing pegs 18 (shown in phantom) which extend from the pegboard 20. In this arrangement, product 62 carried by the peg member 25 is effectively displayed without obstructing the customer's view and access to product 62' (shown in phantom) carried by the pegs 18 attached to the wall-type portion 16.

Thus, an additional display area is created in which the product can be displayed such that it is substantially within the view of a customer traveling down the aisleway without the need for the customer to turn his or her head and/or body to face the gondola merchandising display unit. Such a point of purchase display provides the unique abilities to significantly increase merchandising space, feature certain items, permit organization by manufacturer, draw customers off a store's main aisleway and down the individual merchandise aisleways, and provide an attractive and unique display area for impulse purchase items.

While it will be apparent to those skilled in art that the preferred embodiment is well calculated to fulfill the above-stated objects and advantages, it will also be appreciated that the present invention is susceptible to modification, variation and alteration without departing from the scope and spirit of the claims as set forth below.

What is claimed is:

1. A merchandising display system for merchandising products, the system comprising:

a gondola display unit including a base member and an upwardly extending wall portion;

an auxiliary display assembly including first and second cantilever members and a vertical member, said first and second cantilever members each including a distal end and a proximal end, said distal ends of said cantilever members being interconnected by said vertical member;

means for removably attaching said auxiliary display assembly to said gondola display unit;

a merchandise holder adapted to receive and retain a plurality of products; and means for removably attaching said merchandise holder to said vertical member such that said merchandise holder is positioned horizontally spaced apart from said upright support member and extends substantially parallel to said upwardly extending wall portion.

2. The merchandising display system of claim 1, wherein said means for removably attaching said merchandise holder comprises at least one column of vertically spaced apertures formed in a side of said vertical member, and further wherein said merchandise is adapted to engage at least one of said vertically spaced apertures.

3. The merchandising display system of claim 2, wherein said vertical member is substantially rectangular in cross section and further wherein a first column of vertically spaced apertures is formed in a first side of said vertical member, said first side being substantially perpendicular to said upwardly extending wall portion.

4. The merchandising display system of claim 3, wherein a second column of vertically spaced apertures is formed in a second side of said vertical member, said second side being substantially parallel to said upwardly extending wall portion.

5. The merchandising display system of claim 1, wherein said distal ends of both of said first and second cantilever members are adapted to receive a threaded fastener passing through an aperture formed in said vertical member.

6. The merchandising display system of claim 5, further comprising an intermediate member interconnecting said gondola display unit and said vertical member, said intermediate member being vertically interdisposed between said first and second cantilever members.

7. The merchandising display system of claim 3, wherein said gondola display unit includes an upright support member extending vertically from substantially adjacent said base member, said upright support member being attached to said upwardly extending wall portion and including a first column of vertically spaced slot, and further wherein said means for removably attaching said lateral display assembly comprises a hook portion disposed at the proximal end of both of said first and second cantilever members, each of said hook portions adapted to engage one of said vertically spaced slots of said upright member.

8. A gondola merchandising display system for merchandising products, the system comprising:

a gondola display unit including a base member, an upwardly extending wall portion, and at least one upright support member extending vertically from substantially adjacent said base member, said support member being attached to said upwardly extending wall portion, said upright support member having a first column of vertically spaced slots formed therein;

an auxiliary display assembly including at least three cantilever members, each of said cantilever members each including a distal end and a proximal end, said distal ends of said cantilever members adapted to receive a threaded fastener passing through an aperture in said vertical member, said vertical member having a substantially rectangular cross section and a first column of apertures formed in a first side thereof, said first side being substantially perpendicular to said wall portion;

a hook portion depending from said proximal end of each of said cantilever members, each of said hook portions adapted to removably attach to one of said vertically spaced slots of said upright support member; and at least one peg member adapted to receive and retain a plurality of products, said at least one peg member adapted to engage at least one aperture of said first column of apertures.

9. An auxiliary display assembly for a gondola merchandising display unit, the gondola merchandising display unit being of the type having a base, an upwardly extending wall portion, and at least one upright support member extending vertically from the base and having a column of vertically spaced slots therein, the auxiliary display assembly comprising:

first and second cantilever members, said first and second cantilever members each including a distal end and a proximal end;

a vertical member interconnecting said distal ends of said first and second cantilever members, said vertical member having a substantially rectangular cross-section;

means for removably attaching said first and second cantilever members to said at least one upright support member;

at least one peg member adapted to receive and retain a plurality of products, said at least one peg member including at least one arm, said at least one peg member further being adapted to engage at least one of said vertically spaced apertures of said first column of vertically spaced apertures;

means for removably attaching said at least one peg member to said vertical member such that said peg member is fixedly positioned horizontally spaced apart from said upright support member and said arm extends substantially parallel to said upwardly extending wall portion, said means for removably attaching comprising a first column of vertically spaced apertures formed in a first side of said vertical member, said first side being substantially perpendicular to said upwardly extending wall portion; and said vertical member further including a second column of vertically spaced apertures formed in a second side thereof, said second side being substantially parallel to said upwardly extending wall portion;

whereby the auxiliary display assembly can be removably attached to said gondola merchandising display unit to provide an additional area of merchandising display space.

10. An auxiliary display assembly for a gondola merchandising display unit, the gondola merchandising display unit being of the type having a base, an upwardly extending wall portion, and at least one upright support member extending vertically from the base and having a column of vertically spaced slots therein, the auxiliary display assembly comprising:

first and second cantilever members, said first and second cantilever members each including a distal end and a proximal end;

a vertical member interconnecting said distal ends of said first and second cantilever members;

means for removably attaching said first and second cantilever members to said at least one upright support member;

at least one peg member adapted to receive and retain a plurality of products, said at least one peg member including at least one arm;

means for removably attaching said at least one peg member to said vertical member such that said peg member is fixedly positioned horizontally spaced apart from said upright support member and said arm extends substantially parallel to said upwardly extending wall portion; and said distal ends of both of said first and second cantilever members being adapted to receive a threaded fastener passing through an aperture formed in said vertical member;

whereby the auxiliary display assembly can be removably attached to said gondola merchandising display unit to provide an additional area of merchandising display space.

11. The auxiliary display assembly of claim 10, further comprising at least one intermediate member interconnecting said upright member and said vertical member, said intermediate member being vertically interdisposed between said first and second cantilever members.

* * * * *

UNITED STATES PATENT AND TRADEMARK OFFICE

CERTIFICATE OF CORRECTION

PATENT NO. : 5,443,167

DATED : August 22, 1995

INVENTOR(S) : Menaged et al.

It is certified that error appears in the above-identified patent and that said Letters Patent is hereby corrected as shown below:

Column 2, line 7, "Art" should be --An--.

Column 6, line 20, "shield portion 50" should be --shield portion 54--.

Column 6, line 23, "shield portion 50" should be --shield portion 54--.

Column 6, line 27, "second legs 54" should be --second legs 58--.

Column 7, line 18, claim 1, before "positioned" insert --fixedly--.

Column 7, line 26, claim 10, insert "holder" after merchandise.

Signed and Sealed this

Twenty-second Day of September, 1998

*Attest:*

Bruce Lehman

BRUCE LEHMAN

*Attesting Officer*

*Commissioner of Patents and Trademarks*